US006663475B2

(12) United States Patent
Price

(10) Patent No.: US 6,663,475 B2
(45) Date of Patent: Dec. 16, 2003

(54) GRINDING APPARATUS

(76) Inventor: John Lewis Price, Unit 14, 104 St. Georges Ck., Drummoyne, NSW 2047 (AU)

( * ) Notice: Subject to any disclaimer, the term of this patent is extended or adjusted under 35 U.S.C. 154(b) by 0 days.

(21) Appl. No.: 10/296,345

(22) PCT Filed: May 24, 2001

(86) PCT No.: PCT/AU01/00616

§ 371 (c)(1),
(2), (4) Date: Nov. 25, 2002

(87) PCT Pub. No.: WO01/89764

PCT Pub. Date: Nov. 29, 2001

(65) Prior Publication Data

US 2003/0171082 A1 Sep. 11, 2003

(30) Foreign Application Priority Data

May 26, 2000 (AU) ..... PQ7775

(51) Int. Cl.[7] ..... B24B 21/12

(52) U.S. Cl. ..... 451/297; 451/304; 451/321; 198/814; 474/109; 474/112

(58) Field of Search ..... 451/297–311, 296, 451/310, 304; 198/814; 474/109, 111, 133, 135

(56) References Cited

U.S. PATENT DOCUMENTS

| | | | | | |
|---|---|---|---|---|---|
| 2,489,811 | A | * | 11/1949 | Perkins | 451/308 |
| 2,560,102 | A | * | 7/1951 | Guinn | 451/311 |
| 3,132,451 | A | * | 5/1964 | Kile | 451/311 |
| 3,447,306 | A | * | 6/1969 | Jakimcius | 451/544 |
| 3,577,684 | A | * | 5/1971 | Jakimcius | 451/297 |
| 3,654,739 | A | * | 4/1972 | Stoy et al. | 451/303 |
| 3,686,798 | A | * | 8/1972 | CoPresti | 451/300 |
| 4,268,998 | A | * | 5/1981 | Hansen | 451/311 |
| 4,316,349 | A | * | 2/1982 | Nelson | 451/296 |
| 4,421,228 | A | * | 12/1983 | Marsiglio et al. | 198/814 |
| 4,434,584 | A | | 3/1984 | Rasmussen | 51/135 R |
| 4,443,977 | A | * | 4/1984 | Gaiani | 451/309 |
| 4,603,510 | A | * | 8/1986 | Rasmussen | 451/297 |
| 4,742,649 | A | * | 5/1988 | Fuchs | 451/297 |
| 5,094,036 | A | * | 3/1992 | Botteghi | 451/303 |
| 5,370,585 | A | * | 12/1994 | Thomey et al. | 474/112 |
| 5,759,125 | A | * | 6/1998 | Berg | 474/112 |

FOREIGN PATENT DOCUMENTS

| | | |
|---|---|---|
| AU | 646913 | 6/1992 |
| DE | 198 21 982 | 1/2000 |
| GB | 2 274 796 | 8/1994 |
| JP | 11-856 | 1/1999 |
| JP | 2000-218490 | 8/2000 |

* cited by examiner

*Primary Examiner*—George Nguyen
(74) *Attorney, Agent, or Firm*—Steptoe & Johnson LLP; D. Douglas Price

(57) ABSTRACT

A tool support device for use in a belt grinding apparatus (1), the apparatus including, a drive motor (60), a drive shaft (61) and an abrasive belt arranged to be driven by the drive motor, (60) the tool support device (10) including a primary carriage (20) including a plurality of mounting zones (22, 23, 24) thereon, each mounting zone being adapted to receive a primary working tool assembly, (40, 41, 42), one or more of the primary tool assemblies including a secondary carriage (46) operatively mounted to the primary carriage (20) at one or respective one of the mounting zones (22, 23, 24) the primary carriage (20) being mounted for rotary movement so that it can adopt a plurality of working positions, wherein in each working position one of the primary working tools can be selectively disposed at a work station in an operative position, the secondary carriage (46) having a plurality of additional working tools thereon, the secondary carriage (46) being adapted for rotary movement relative to the primary carriage (20) so that one of the additional working tools can be disposed in an operative position when at the work station.

28 Claims, 8 Drawing Sheets

GRINDING APPARATUS

The present invention relates generally to grinding apparatus and more particularly to apparatus using abrasive grinding belts.

Abrasive belt grinding apparatus are used in a variety of applications and can be used for flat grinding procedures or contour grinding procedures. In many grinding applications such as for example in knifemaking and other general grinding and polishing operations relative complicated contours are often required necessitating the use of a relatively large number of different tools. Such tools can be in the form of contact wheels of different diameters over which the abrasive belt can pass. Most currently known apparatus are adapted to only support one tool at a time. As such, it is necessary to continually change tools where complicated contours are being formed This is not only time consuming but costly.

In U.S. Pat. No. 4,434,584 there is described turret belt grinder which is adapted to support different size contact wheels in a support frame with an abrasive belt extending over the wheels. The frame is adapted to be rotated relative to mounting structure and is adapted for rotation relative thereto so that each wheel can be rotated to a common work station. The abrasive belt is driven by a V-belt which transmits power from a centrally located motor shaft to a contact drive wheel. This device suffers from several drawbacks. For example, in order to access internal square corners the number of tools which can be carried by the support frame is limited to three. In addition the drive arrangement is complicated and limits the functionality of the device.

Another problem associated with abrasive belt grinding apparatus is control of the belt during operation Belt tracking devices are known but are usually relatively complicated and can be unreliable.

It is therefore an object of the present invention to provide apparatus which alleviates one or more of the aforementioned problems.

According to one aspect of the present invention there is provided a tool support device for use in a belt grinding apparatus, the apparatus including, a drive motor, a drive shaft, and an abrasive belt arranged to be driven by the drive motor. The tool support device includes a primary carriage operatively connectable to a support structure, the primary carriage including a plurality of mounting zones thereon, each mounting zone being adapted to receive a primary working tool assembly, one or more of the primary tool assemblies including a secondary carriage operatively mounted to the primary carriage at one or respective ones of the mounting zones, the primary carriage being mounted for rotary movement so that it can adopt a plurality of working positions, wherein in each working position one of the primary working tools can be selectively disposed at a work station in an operative position, the secondary carriage having a plurality of additional working tools thereon, the secondary carnage being adapted for rotary movement relative to the primary carriage so that one of the additional working tools can be disposed in an operative position when at the work station.

The apparatus may be arranged so that there is a single work station or multiple work stations. When in use the abrasive belt is adapted to be entrained around at least some of the primary tool assemblies.

In one preferred form, the primary carriage may include three mounting zones, each of the zones being adapted to receive a respective primary tool assembly. Two of the primary tool assemblies may be in the form of contact wheels of different diameter. The additional working tools on the or each secondary carriage may also be in the form of contact wheels which are of different diameter to the first mentioned contact wheels. Desirably, because there are only three mounting zones, this permits tools in each zone to be capable of grinding internal radiuses in square corners.

In one preferred embodiment the primary carriage may include a plate like body mounted to a support structure for rotation about an axis of rotation. Preferably, the primary carriage is mounted to the housing of the motor of the grinding apparatus.

Preferably, the plate-like body of the carriage is generally triangular in shape with the mounting zones being disposed in the general region of the three apexes of the triangular shaped plate. Preferably, the angle of the plate like body at each of the apexes is less than 90°.

In a preferred form of the invention when in the assembled position, the drive shaft of the motor is operatively connected to one of the contact wheels so as to generally coaxial therewith, this contact wheel causing movement of the abrasive belt over the other working tool assemblies. Preferably, rotation of the primary carriage is about the axis of the drive shaft.

The device may further include a platen operatively connected to the primary carriage body in a position between the mounting zones. The platen is arranged adjacent the abrasive belt when in use for use in flat grinding operations.

The secondary carriage may in one form include a carriage body which is mounted for rotation on the primary carriage at one or two of the mounting zones so that it can adopt a plurality of operative positions. The secondary carriage body may include a hub section and three sets of generally radially extending mounting arms each set of mounting arms being adapted to support a respective contact wheel. Locking means which may be in the form of a releasable locking pin may be provided to lock the secondary carriage relative to the primary carriage in a selected one of its operating positions.

The device may further include a locking assembly for releasably holding the primary support carriage in a selected one of its operating positions. In one form, the locking assembly may include a mounting plate having a plurality of locating recesses therein, the mounting plate being attached to the housing of the motor. A detent is operatively connected to the carriage through an adjustment arm, the detent being adapted to cooperate with the locating recesses to hold the carriage relative to the motor in one of a selected number of operating positions. A spring may be arranged to urge the detent into engagement with a selected one of the locating recesses.

Preferably, at least some of the tool assemblies are operatively mounted to the primary carnage by means of adjustable generally conical shaped mounting pivots. By this arrangement any wear between the parts can be adjusted for. This feature is particular valuable in provided for accurate tracking of the belt over the tool assemblies. Furthermore, low friction material such as Teflon preferably in the form of a layer may be provided between the primary carriage and the tool assembly.

The apparatus may further include a belt tensioning device which in one form includes a lever and slot assembly which causes movement of tool assembly relative to the support carriage to thereby relieve or apply a tension to the belt.

One or more safety shields may be provided at the mounting zones. In a preferred form the or each safety shield may include a main body mounted to the primary carriage for pivotal movement relative thereto between a retracted position and an in use position The shield further includes a cover portion which in the in use position overlies the belt.

According to another aspect of the present invention there is provided a tracking adjustment mechanism for correcting the tracking of a belt on a belt drive. The mechanism including an axle assembly operatively mounted to a support carriage, the assembly including an axle upon which a contact wheel is mounted for rotation, the axle includes opposed end bearings one of which provides for at least limited pivotal movement of the axle. Preferably, the limited pivotal movement in is the form of limited universal movement. The bearing may include an adjustable ball and socket assembly. The other bearing may include an eccentric thereon which is operable by a lever so that rotation of the eccentric causes pivotal movement of the axle in the other bearing thereby adjusting the position of the axle relative to the support carriage. This tracking adjustment mechanism may be used in the tool support device according to the first mentioned aspect of the invention.

Preferably, the tracking mechanism includes an axle assembly which is mountable to the primary carriage via mounting brackets, each having a bearing mounting therein. One of the bearing mountings may be in the form of a curved mounting surface in the mounting bracket which is complementary in shape to a portion of a sphere. The other bearing mounting may be in the form of a circular aperture in mounting bracket.

The axle assembly may further include an axle having end bearings, these end bearings being receivable within respective bearing mountings on the mounting brackets. The end bearing may be in the form of a at least part hemispherical ball which in the assembled position is adapted to be disposed within the curved mounting surface of the bearing mounting. The bearing may be in the form of a head of a screw element which is securable to axle. An adjustment nut enables the bearing to be tightly received within the bearing mounting socket and enables subsequent adjustment if wearing occurs.

The other bearing may be in the form of a collar which is eccentrically disposed with respect to the longitudinal axis of the axle. The collar is receivable within bearing mounting and can be rotated therein by means of actuating lever. A spring which may be in the form of a disc spring ensures that the various parts are held in a tight relationship with respect to one another.

It will be appreciated that the apparatus of the present invention can provide up to seven different tools with each tool being able to access an internal square corner of the component being worked.

Preferred embodiments of the invention will be hereinbefore described with reference to the accompanying drawings, and in those drawings.

Figure 1:
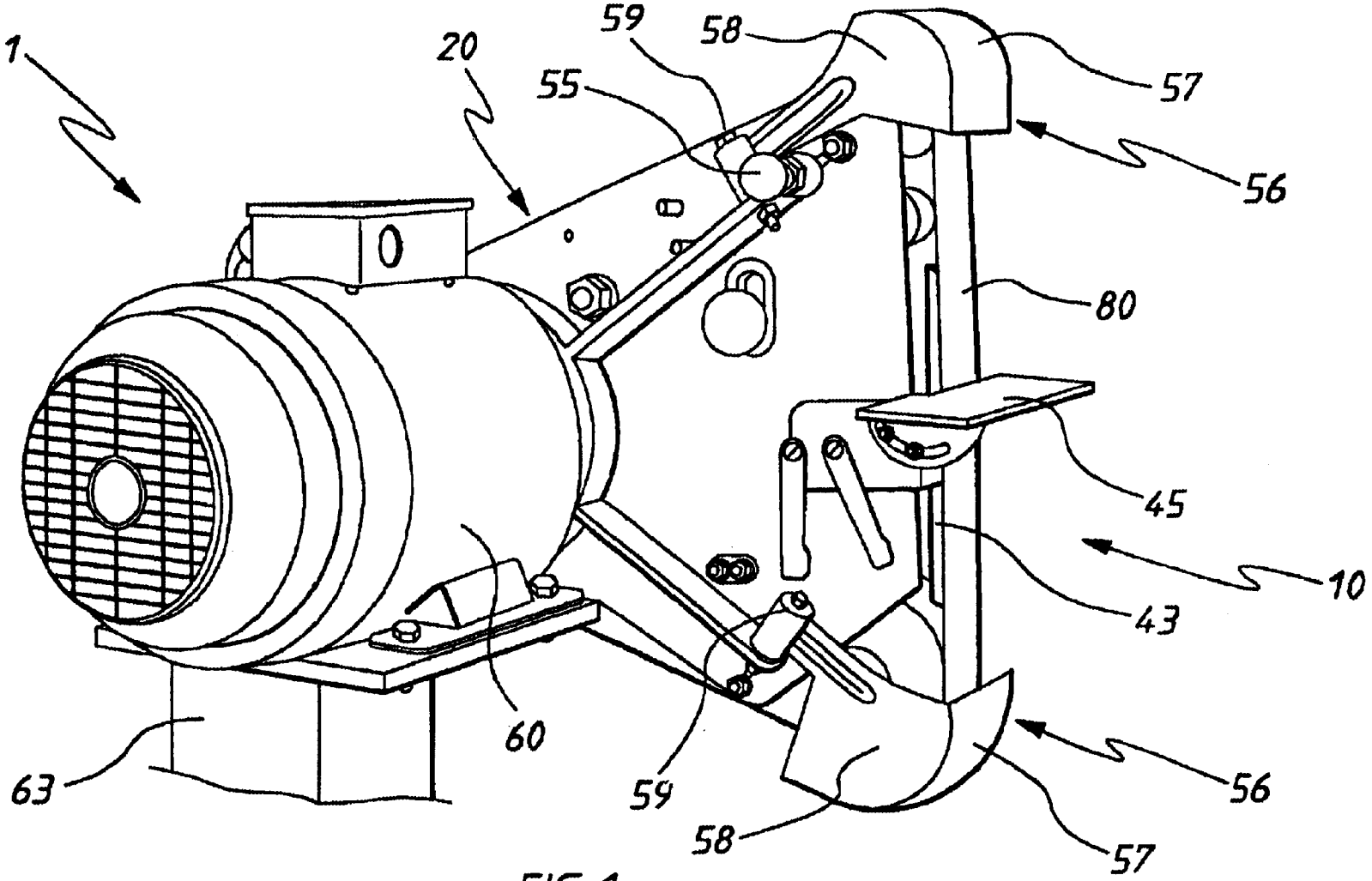
FIG. 1 is a rear view of grinding apparatus having a tool support device according to the present invention.
Figure 2:
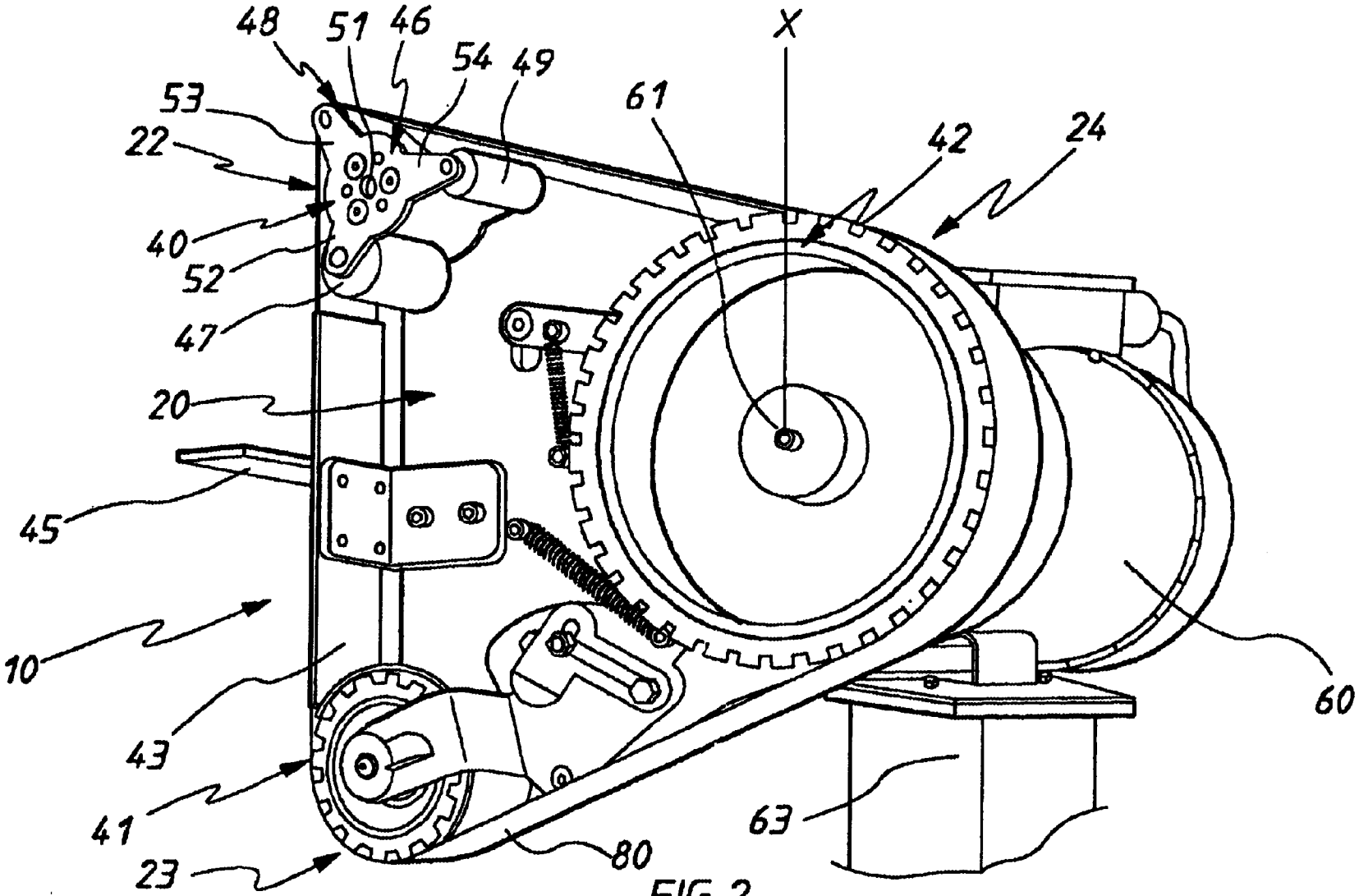
FIG. 2 is a front view of the apparatus shown in FIG. 1.
Figure 3:
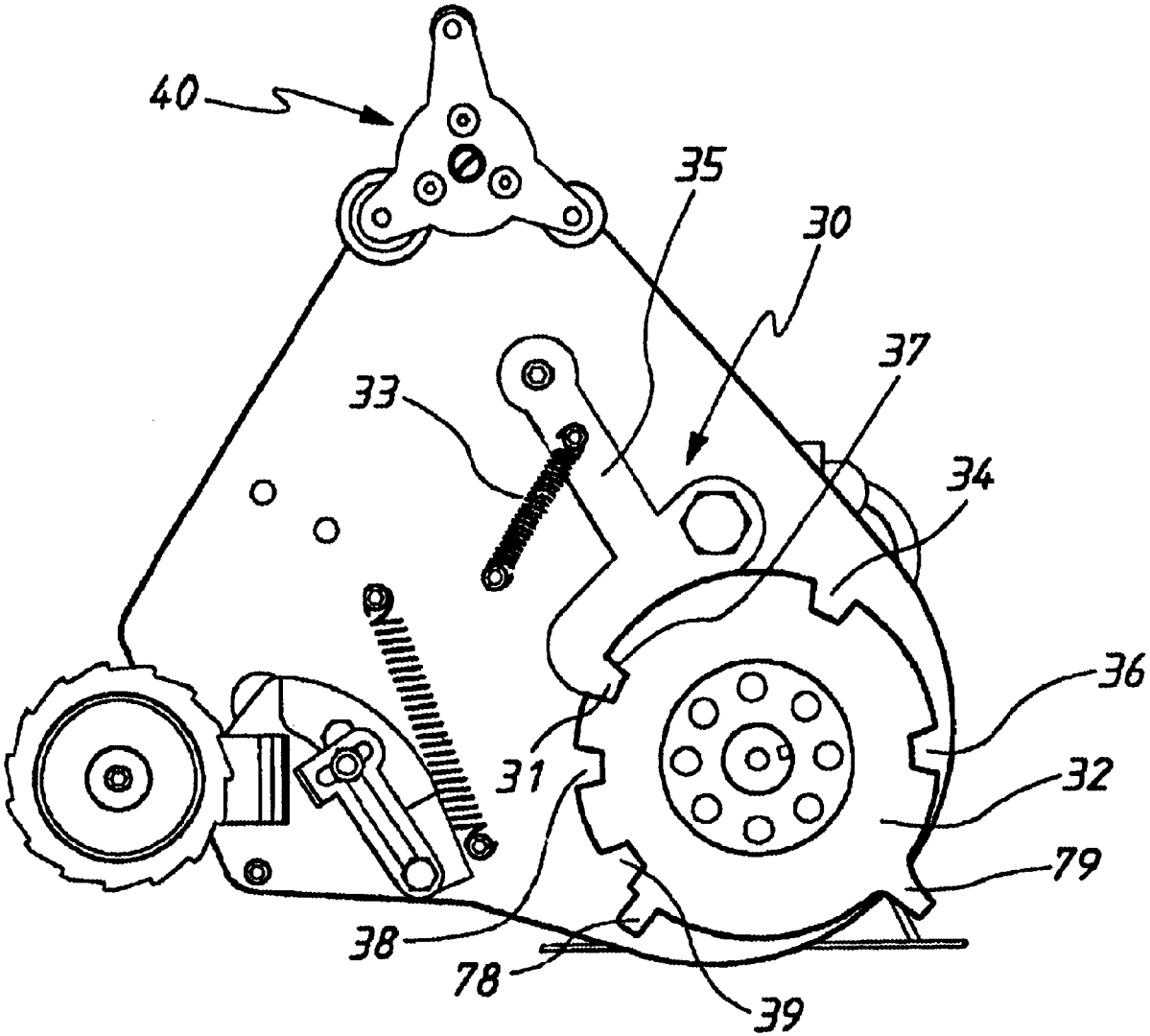
FIG. 3 is a front view of the apparatus showing the locking assembly of the tool support device.
Figure 4:
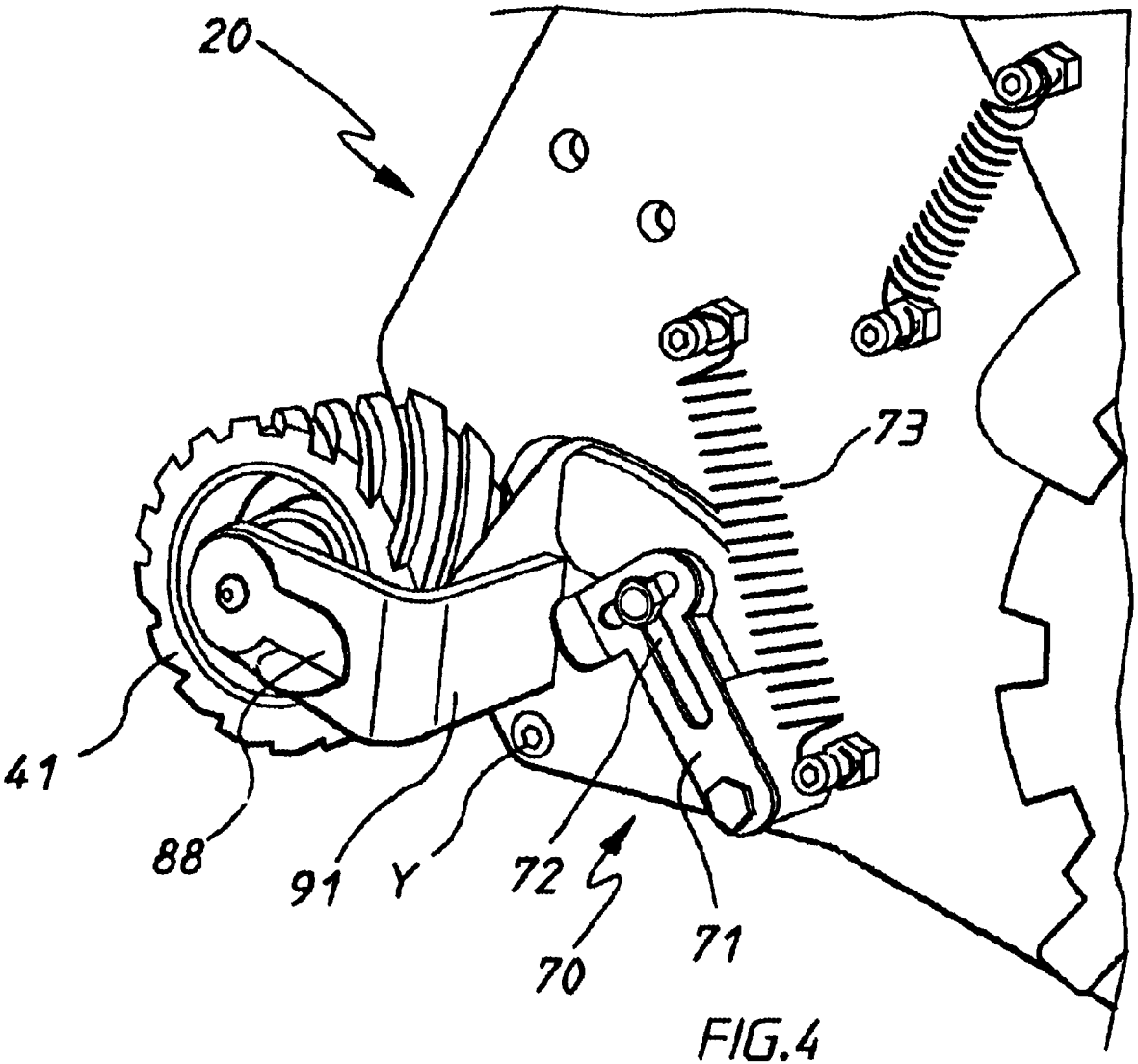
FIG. 4 is a detail of the belt tensioning assembly of the tool support device.
Figure 5:
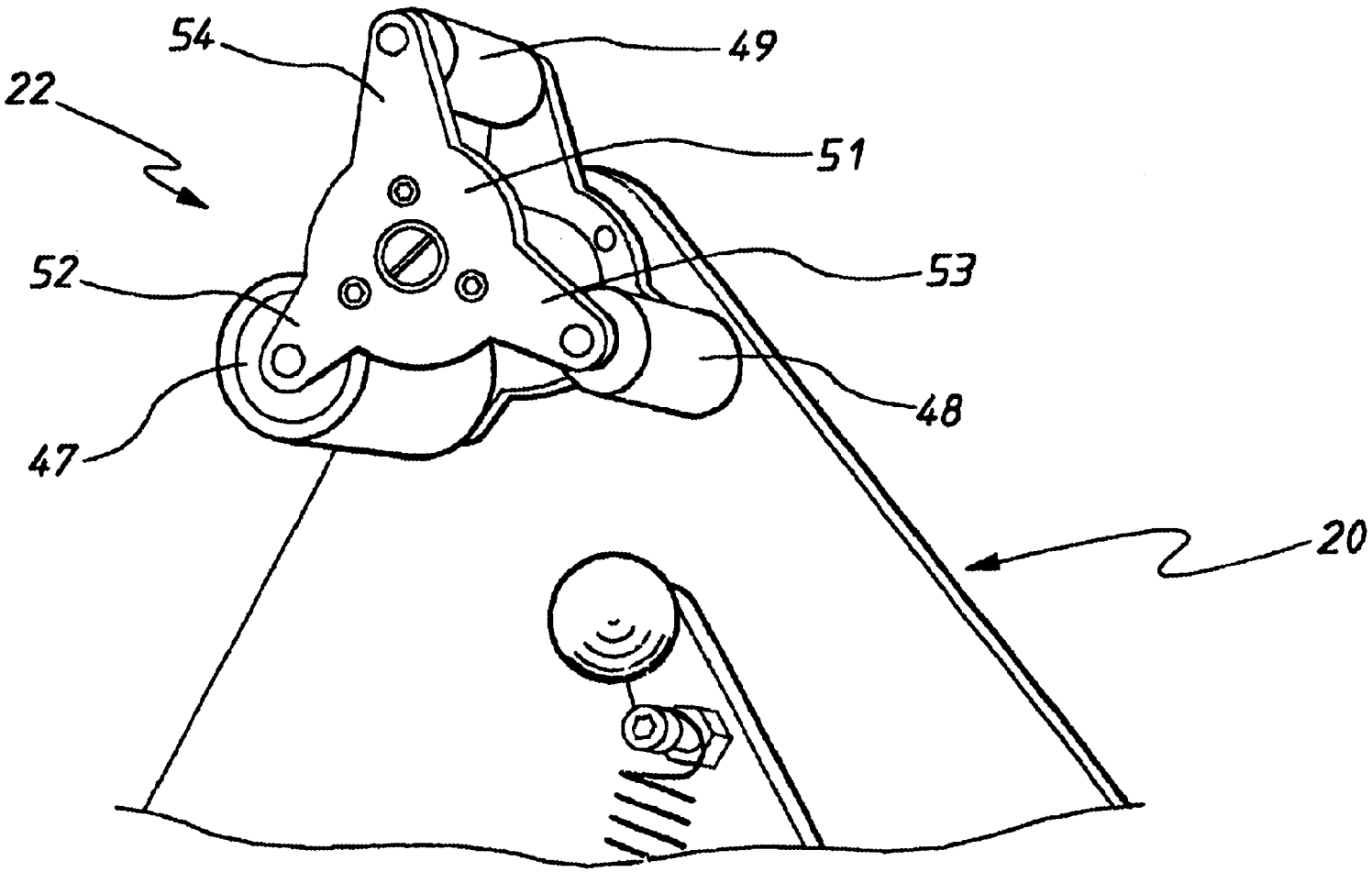
FIG. 5 is a front detail of the secondary carriage of the tool support device.
Figure 6:
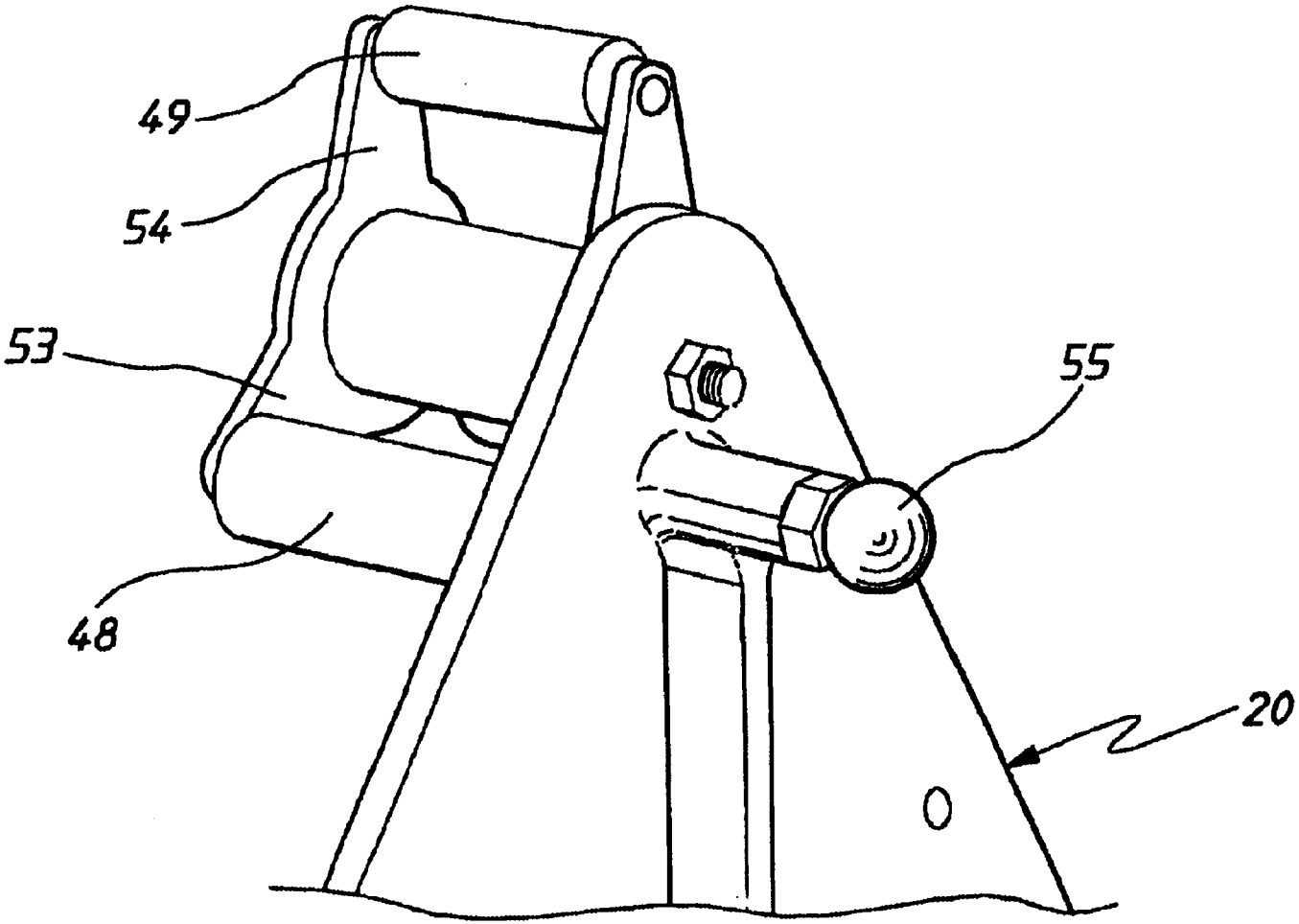
FIG. 6 is a rear view of the secondary carriage shown in FIG. 5.

Referring to the drawings there is shown a grinding apparatus generally indicated at 1 which includes a drive motor in the form of an electric motor 60 having a drive shaft 61. The motor is mounted on a stand 63 or for example, a right hand corner of a bench or table.

The tool support device generally indicated at 10 includes a primary carriage 20 which is operatively connected to a section of the drive motor 60. The carriage 20 includes a generally plate like body which is generally triangular in shape, the body being mounted to the motor for movement about a rotation axis X so that it can adopt a plurality of different operating positions. A locking mechanism 30 is provided to lock the carriage with respect to the motor housing. The locking mechanism 30 includes a mounting plate 32 having a plurality of locating recesses 34, 36, 37, 38, and 39 therein, the mounting plate being attached to the housing of the motor. Limit stops 78 and 79 limit rotation of the carriage 20 relative to axis X. A detent 31 is operatively connected to the carriage 20 through an adjustment arm 35, the detent being adapted to cooperate with the locating recesses to hold the carriage relative to the motor in one of a selected number of operating positions. A spring 33 is arranged to urge the detent into engagement with a selected one of the locating recesses.

The primary carriage 20 further includes a plurality of mounting zones 22, 23, and 24, each zone being adapted to receive in a mounted position a selected primary working tool assembly 40, 41, and 42. Two of the tool assemblies 41 and 42 are in the form of contact wheels of different diameters. A platen 43 and table 45 are provided between the assemblies 40 and 41. The contact wheels are for use in the contour grinding and the platen is for use in flat grinding.

Another of the tool assemblies 40 includes a secondary carriage 46 to which a plurality of additional tools are mounted. The additional tools 47, 48 and 49 comprise contact wheels of various diameters. The secondary carriage 46 includes a hub portion 51 and three sets of mounting arms 52, 53 and 54 which are fitted with bearings in those arms to which the contact wheels are mounted. The hub portion is adapted to be rotated relative to the primary carriage so that each of the secondary tools can be selectively positioned on an operative working configuration A locking pin 55 locks the hub in the selected operating position.

Safety shields 56 are provided at some of the mounting zones. The shield 56 includes a main body 58 and cover 57, the main body being pivotally mounted to carriage via pin 59.

Figure 7:
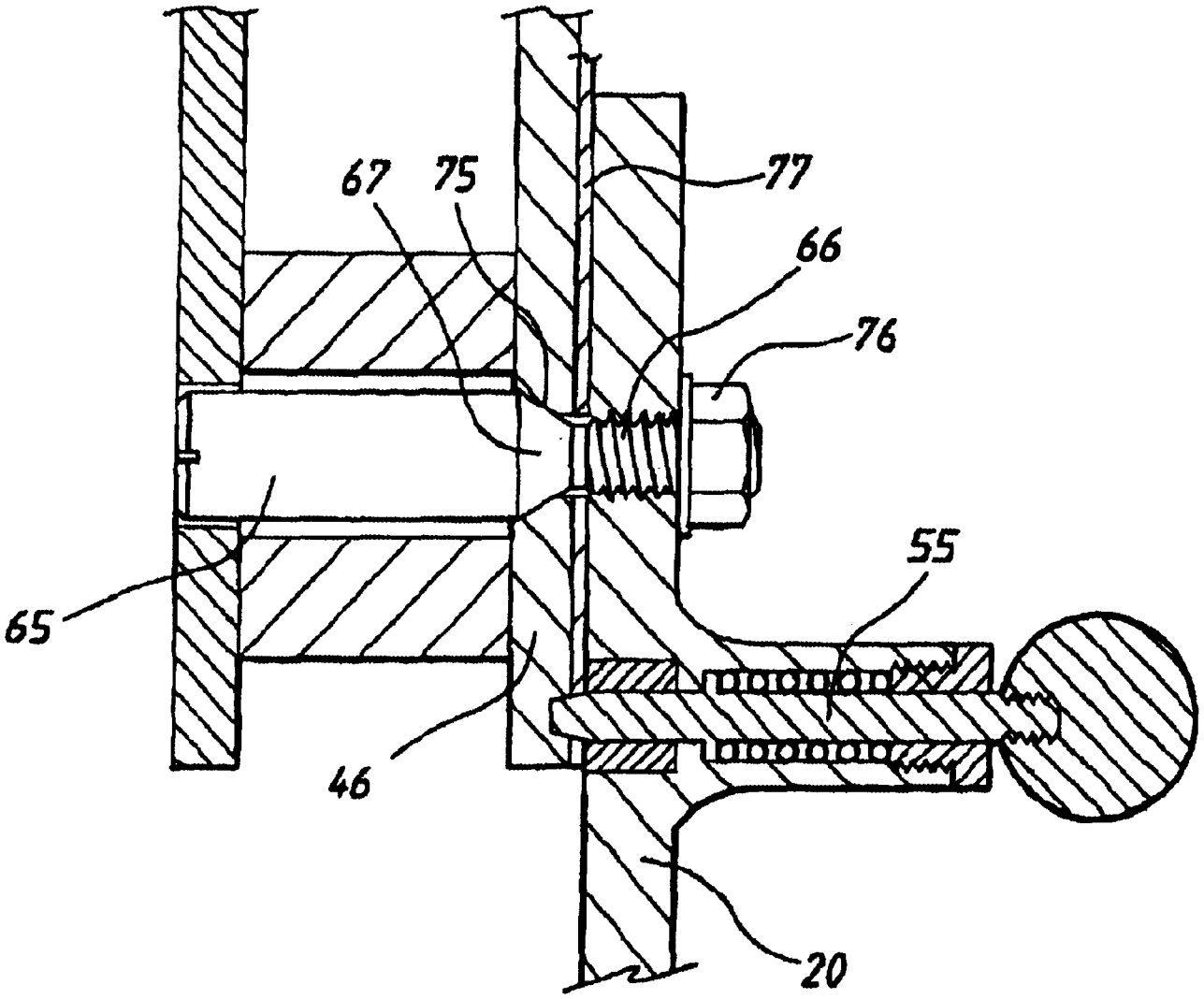
FIG. 7 is a partial sectional view detailing the mounting of a tool assembly to the primary carriage.
Figure 8:
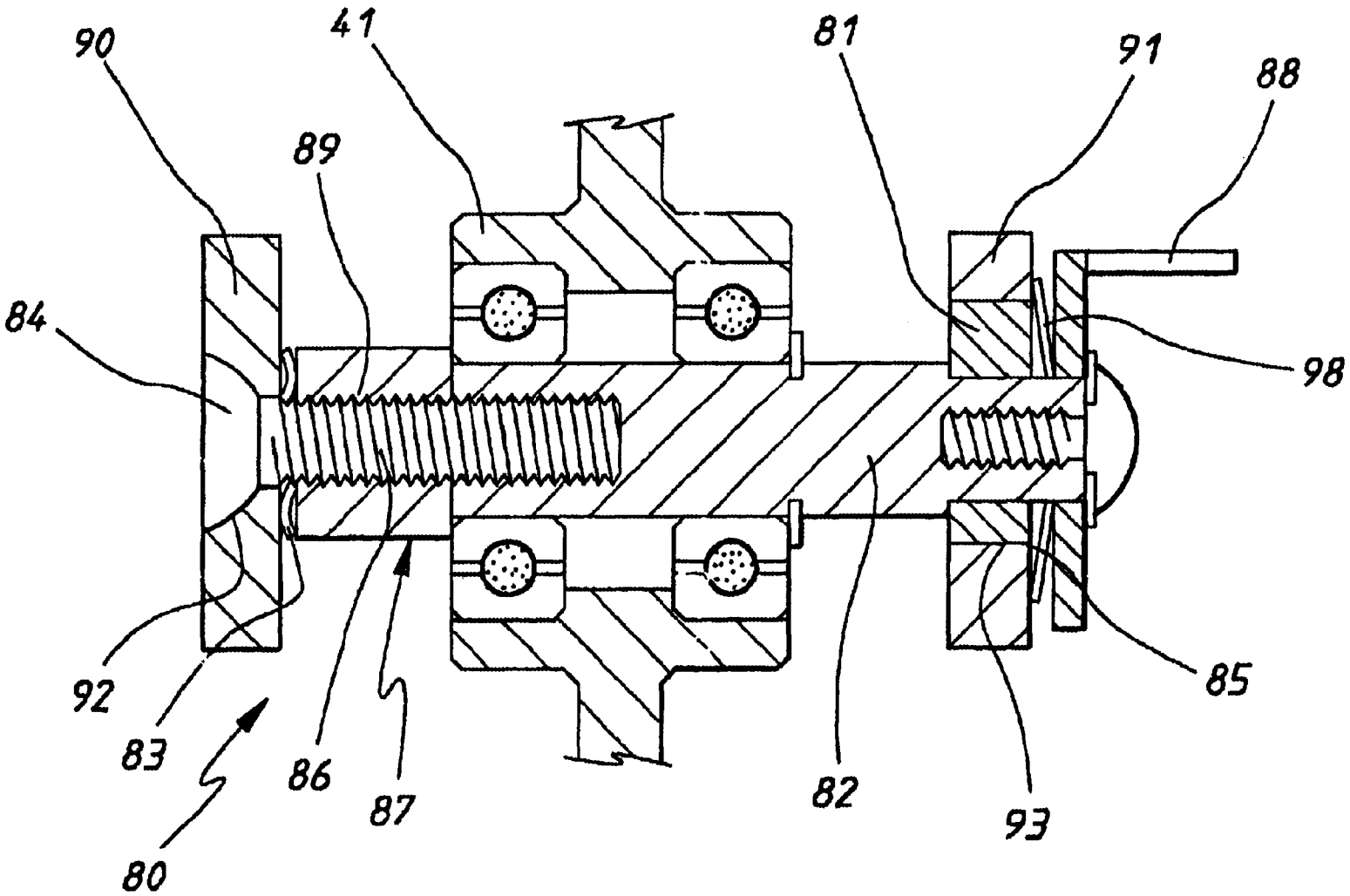
FIG. 8 is a sectional view detailing the tracking mechanism according to one aspect of the present invention.

Referring to FIG. 7 there is shown an arrangement by which a tool assembly such as secondary carriage 46 can be mounted to the primary carriage 20. The mounting includes a pivot member 65 which includes a stem 66 and a conical section 67. Stem 66 is in threaded engagement with carriage 20. The conical section 67 is received within a complementary shaped aperture 75 in the secondary carriage 46. A tightening nut 76 is fitted to the stem 66 of the pivot member. A teflon panel or layer 77 is disposed between the primary carriage 20 and the secondary carriage 46. The conical section 67 ensures that there is not excessive clearance between the two parts and facilitates adjustment if or when wear occurs. Spring loaded locking pin 55 locks the hub of the secondary carriage into a selected operating position Pin 55 passes through a hardened bush in the carriage 20.

A continuous or endless belt 80 is arranged to extend at least partially around or over the tool assemblies.

As shown one of the primary tool assemblies 42 is operatively connected to the drive shaft of the motor so that rotation thereof causes rotation of the belt around the various tool assemblies.

The apparatus further includes a belt tensioning device 70 which causes movement of tool assembly 41 relative to the support carriage 20 to thereby relieve or apply a tension to the belt about pivot axis X. A Fining catch 71 with slot assembly 72 locks the tensioning device 70 in the retracted position to facilitate belt changing. Spring 73 urges the device 70 and thereby the tool assembly 41 into a position which places the belt under tension.

The tracking mechanism generally indicated at 80 includes an axle assembly 87 which is mountable to the prim carriage 20 via mounting brackets 90 and 91, each having a bearing mounting 92 and 93 therein. One of the bearing mountings 92 is in the form of a curved mounting surface in mounting bracket 90 which is complementary in shape to a portion of a sphere. The other bearing mounting 93 is in the form of a circular aperture in mounting bracket 91.

The axle assembly 87 comprises an axle 82 having end bearings 84 and 85, these end bearings being receivable within respective bearing mountings 92 and 93 on the mounting brackets 90 and 91. The end bearing 84 is in the form of a at least part hemispherical ball which in the assembled position is adapted to be disposed within the curved mounting surface of the bearing mounting 92. The bearing 84 is in the form of a head of a screw element 86 which is securable to axle 82. An adjustment nut 89 enables the bearing 84 to be tightly received within the bearing mounting socket 92 and enables subsequent adjustment if wearing occurs.

Bearing 85 is in the form of a collar 81 which is eccentrically disposed with respect to the longitudinal axis of the axle 82. Preferably, the collar 81 is foamed of a material which has some resilience such as example plastics such as urethane preferably a relative hard urethane. The collar 81 is receivable within bearing mounting 91 and can be rotated therein by means of actuating lever 88. A spring in the form of a wave spring 83 ensures that the various parts are held in a tight relationship with respect to one another. A further spring 98 is provided at the other end of the assembly.

The reference to any prior art in this specification is not, and should not be taken as, an acknowledgment or any form of suggestion that that prior art forms part of the common general knowledge in Australia.

Finally, it is to be understood that various alterations, modifications and/or additions may be incorporated into the various constructions and arrangements of parts without departing from the spirit or ambit of the invention.

The claims defining the invention are as follows:

1. A tool support device for use in a belt grinding apparatus, the apparatus including; a drive motor, a drive shaft, and an abrasive belt arranged to be driven by the drive motor, the tool support device including a primary carriage operatively connected to a support structure, the primary carriage including a plurality of mounting zones thereon, each mounting zone being adapted to receive a primary working tool assembly, one or more of the primary tool assemblies including a secondary carriage operatively mounted to the primary carriage at one or respective ones of the mounting zones, the primary carriage being mounted for rotary movement so that it can adopt a plurality of working positions, wherein in each working position one of the prim working tools can be selectively disposed at a work station in an operative position, the secondary carriage having a plurality of additional working tools thereon, the secondary carnage being adapted for rotary movement relative to the primary carriage so that one of the additional working tools can be disposed in an operative position when at the work station.

2. A tool support device according to claim 1 wherein the primary carriage includes three mounting zones, each of the zones being adapted to receive a respective primary tool assembly.

3. A tool support device according to claim 2 wherein two of the primary tool assemblies are in the form of contact wheels of different diameter.

4. A tool support device according to claim 2 wherein two said secondary carriages are provided at respective mounting zones.

5. A tool support device according to claim 4 wherein additional working tools on the or each secondary carriage are in the form of contact wheels which are of different diameter to the first mentioned contact wheels.

6. A tool support device according to claim 1 wherein the primary carriage includes a plate like body mounted to a support structure for rotation about an axis of rotation.

7. A tool support device according to claim 6 wherein the plate-like body of the carriage is generally triangular in shape with the mounting zones being disposed in the general region of the three apexes of the triangular shaped plate.

8. A tool support device according to claim 1 wherein when in the assembled position, the drive shaft of the motor is operatively connected to one of the contact wheels so as to be generally co-axial therewith, this contact wheel causing movement of the abrasive belt over the other working tool assemblies.

9. A tool support device according to claim 8 wherein rotation of the primary carriage is about the axis of the drive shaft.

10. A tool support device according to claim 1 further including a platen operatively connected to the primary carriage body in a position between the mounting zones, the platen being arranged adjacent the abrasive belt when in use for use in flat grinding operations.

11. A tool support device according to claim 1 wherein the secondary carriage includes a carriage body which is mounted for rotation on the primary carriage at one or two of the mounting zones so that it can adopt a plurality of operative positions, the carriage body including a hub section and three sets of generally radially extending mounting arms, each set of mounting arms being adapted to support a respective contact wheel.

12. A tool support device according to claim 11 further including locking means in the form of a releasable locking pin may be provided to lock the secondary carriage relative to the primary carriage in a selected one of its operating positions.

13. A tool support device according to claim 1 further including a locking assembly for releasably holding the primary support carriage in a selected one of its operating positions, the locking assembly including a mounting plate having a plurality of locating recesses therein, the mounting plate being attached to the housing of the motor, a detent operatively connected to the carriage through an adjustment arm, the detent being adapted to cooperate with the locating recesses to hold the carriage relative to the motor in one of a selected number of operating positions, and a spring arranged to urge the detent into engagement with a selected one of the locating recesses.

14. A tool support device according to claim 1 wherein at least some of the tool assemblies are operatively mounted to the primary carriage by means of adjustable generally conical shaped mounting pivots.

15. A tool support device according to claim 1 further including a belt tensioning device which includes a lever and slot assembly which causes movement of tool assembly relative to the support carriage to thereby relieve or apply a tension to the belt.

16. A tool support device according to claim 1 further including a tracking adjustment mechanism for correcting the tracking of the belt on the various tool assemblies, the mechanism including an axle assembly operatively mounted to a support carriage, the assembly including an axle upon which a contact wheel is mounted for rotation, the axle including opposed end bearings one of which provides for at least limited pivotal movement of the axle, the other bearing including an eccentric thereon which is operable by a lever so that rotation of the eccentric causes pivotal movement of the axle in the other bearing thereby adjusting the position of the axle relative to the support carriage.

17. A tool support device according to claim 16 wherein said limited pivotal movement is a limited universal movement.

18. A tool support device according to claim 16 wherein said end bearing includes an adjustable ball and socket assembly.

19. A tool support device according to claim 16 wherein the tracking mechanism includes an axle assembly which is mountable to the primary carriage via mounting brackets, each having a bearing mounting therein, one of the bearing mountings being in the form of a curved mounting surface in the mounting bracket which is complementary in shape to a portion of a sphere, the other bearing mounting in the form of a circular aperture in the mounting bracket.

20. A tool support device according to claim 17 wherein the axle assembly further includes an axle having end bearings, these end bearings being receivable within respective bearing mountings on the mounting brackets, the end bearing being in the form of a at least part hemispherical ball which in the assembled position is adapted to be disposed within the curved mounting surface of the bearing mounting, the bearing being in the form of a head of a screw element which is securable to axle, there further being provided an adjustment nut which enables the bearing to be tightly received within the bearing mounting socket and enables subsequent adjustment if wearing occurs.

21. A tool support device according to claim 18 wherein the other bearing is in the form of a collar which is eccentrically disposed with respect to the longitudinal axis of the axle, the collar being receivable within bearing mounting and rotated therein by means of actuating lever, and spring in the form of a wave spring ensures that the various parts are held in a tight relationship with respect to one another.

22. A tool support device according to claim 1 further including a safety shield located at at least one of said mounting zones, said safety shield including a mounting portion for the shield to the primary carriage for swinging movement between a first position in which the shield shroud overlies the mounting zone and retracted position in which it is spaced from the work zone.

23. A tracking adjustment mechanism for correcting the tracking of a belt on a belt drive assembly, the mechanism including an axle assembly operatively mounted to a support, the assembly including an axle upon which a contact wheel is mounted for rotation, the axle including opposed end bearings one of which provides for at least limited pivotal movement of the axle, the other bearing including an eccentric thereon which is operable by a lever so that rotation of the eccentric causes pivotal movement of the axle in the other bearing thereby adjusting the position of the axle relative to the support carriage.

24. A tracking adjustment mechanism according to claim 23 wherein said limited pivotal movement is a limited universal movement.

25. A tracking adjustment mechanism according to claim 23 wherein said other bearing includes an adjustable ball and socket assembly.

26. A tracking mechanism according to claim 23 including an axle assembly which is mountable to a primary carriage via mounting brackets, each having a bearing mounting therein, one of the bearing mountings in the form of a curved mounting surface in the mounting bracket which is complementary in shape to a portion of a sphere, the other bearing mounting in the form of a circular aperture in mounting bracket.

27. A tracking mechanism according to claim 26 wherein the axle assembly includes an axle having end bearings, these end bearings being receivable within respective bearing mountings on the mounting brackets, the end bearing being in the form of a at least part hemispherical ball which in the assembled position is adapted to be disposed within the curved mounting surface of the bearing mounting, the bearing being in the form of a head of a screw element which is securable to axle, and an adjustment nut enabling the bearing to be tightly received within the bearing mounting socket and enables subsequent adjustment if wearing occurs.

28. A tracking mechanism according to claim 27 wherein the other bearing is in the form of a collar which is eccentrically disposed with respect to the longitudinal axis of the axle, the collar being receivable within bearing mounting and can be rotated therein by means of actuating lever, and a spring in the form of a disc spring ensures that the various parts are held in a tight relationship with respect to one another.

* * * * *